United States Patent [19]

Schwankl

[11] Patent Number: 4,510,986

[45] Date of Patent: Apr. 16, 1985

[54] MAGNETICALLY ATTACHED STORM WINDOWS AND THE LIKE

[76] Inventor: Rose M. Schwankl, 9604 W. 106th St., Overland Park, Kans. 66212

[21] Appl. No.: 444,660

[22] Filed: Nov. 26, 1982

Related U.S. Application Data

[63] Continuation of Ser. No. 173,969, Jul. 31, 1980.

[51] Int. Cl.[3] ..... A47H 23/01; E06B 3/28

[52] U.S. Cl. ..... 160/354; 160/368 R; 52/202

[58] Field of Search ..... 160/354, 368 R; 52/DIG. 13, DIG. 4, 202

[56] References Cited

U.S. PATENT DOCUMENTS

| | | | |
|---|---|---|---|
| 3,102,314 | 9/1963 | Alderfer | 52/DIG. 4 |
| 3,263,736 | 8/1966 | Macomson | 160/368 S |
| 3,679,505 | 7/1972 | Hinderaker et al. | 160/354 |
| 4,272,942 | 6/1981 | Jackson | 52/202 |

FOREIGN PATENT DOCUMENTS

| | | | |
|---|---|---|---|
| 2279921 | 2/1976 | France | 160/354 |
| 1043272 | 9/1966 | United Kingdom | 52/DIG. 4 |

*Primary Examiner*—Peter M. Caun
*Assistant Examiner*—Cherney S. Lieberman
*Attorney, Agent, or Firm*—Litman, Day and McMahon

[57] ABSTRACT

An inside storm window or other window cover is mounted to a window frame by two magnetic tape strips, one which adheres to the frame and another which adheres to the window cover. Before the second tape strip is attached to the window cover, it is positioned with its magnetic side face to face with the first strip so that the strips are oriented to magnetically attract one another at all points around the window. Then, the window cover is attached to the second strip, and the magnetic attraction between the tape strips assures an effective seal around the entirety of the window.

4 Claims, 4 Drawing Figures

MAGNETICALLY ATTACHED STORM WINDOWS AND THE LIKE

This is a continuation of application Ser. No. 173,969, filed July 31, 1980.

BACKGROUND OF THE INVENTION

This invention relates to a magnetic tape arrangement for mounting storm windows, insect screens and other articles in position to cover a window opening.

Storm windows have proven to be highly effective in preventing leakage of air through windows and have been widely used in recent years, primarily due to the increased emphasis that has been placed on energy efficiency. Perhaps the principal problem associated with most storm windows is their lack of aesthetic appeal. For example, inside storm windows are temporarily held in place by conventional fasteners such as clamps and the like. Fastening elements of this type are so unattractive that they detract significantly from the overall appearance of the window. Primarily for this reason, inside storm windows have not been used as widely as they might be otherwise, nor have other types of window covers.

It has been proposed that magnets be used to attach covers, screens, nets and various other objects to a window. In this type of arrangement, a metal strip extends around the window frame to adhere to magnets or magnetic tape carried on the window cover. Due to the unattractive appearance of the metal strip, the aesthetic problems are much the same as in the case of more conventional fastening devices. Also, if individual magnetic elements are used, gaps are presented between the cover and the frame, and the effectiveness of the cover suffers accordingly. The use of a metal strip creates further problems in that it is expensive and difficult to install.

SUMMARY OF THE INVENTION

The present invention utilizes one strip of magnetic tape on a window frame and another tape strip on a storm window, screen or other type of window cover. The magnetic strips adhere to one another to securely hold the window cover in place while permitting it to be easily removed and replaced as desired. In the case of a storm window, the tape strips can be painted, antiqued, laminated or otherwise treated to give them a pleasant appearance that is compatible with the appearance of the window to provide a much more attractive storm window than has been achieved in the past.

The reason that a pair of mutually attractive magnetic tape strips have not been successfully used in the past is believed to be related to difficult problems that are encountered in achieving continuous magnetic attraction of the tapes completely around the window opening. If the tape strips repel one another at any point, a gap is created and the storm window or insect screen is ineffective in sealing the window. Due to the alternating polarity pattern of magnetic tape, it is highly difficult to place two long pieces of tape together such that they attract one another at all points along their lengths. Therefore, the tape cannot simply be applied to the window frame and to the storm window in random fashion since there are almost inevitably places where the polarities are misaligned. Random application of the tape thus invariably results in magnetic repulsion between the tapes and gaps at the points of repulsion.

We have overcome this problem by assuring that the two tape strips are properly oriented to attract one another magnetically before the tape strips are permanently attached to both the storm window and the window frame. In accordance with the invention, the first tape strip is adhesively attached to the window frame in extension around the window. The second strip, while loose from the storm window, is applied to the magnetic side of the first strip and is positioned such that there is magnetic attraction between the two strips at all points. Only then is the storm window applied to the adhesive side of the second strip. In this manner, a tight seal between the storm window and frame is assured completely around the window, and there are no points where the tape strips repel one another. The storm window can be removed and replaced with assurance that the magnetic tape strips will be properly oriented to attract one another at all points to thus provide an effective seal between the storm window and the window frame.

DETAILED DESCRIPTION OF THE INVENTION

In the accompanying drawing which forms a part of the specification and is to be read in conjunction therewith and in which like reference numerals are used to indicate like parts in the various views.

Figure 1:
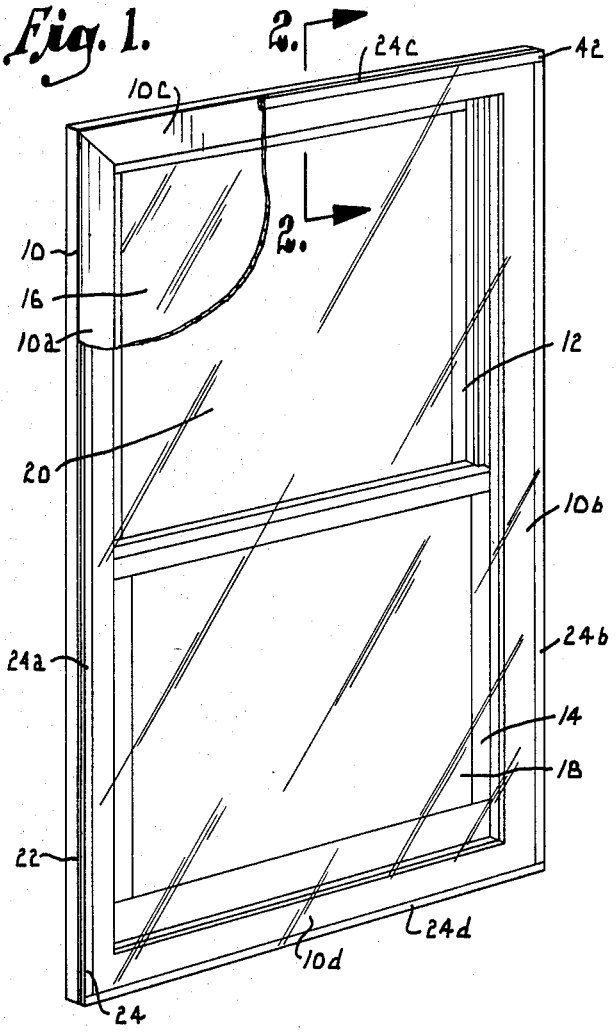
FIG. 1 is a perspective view of an inside storm window which is applied to a window frame in accordance with a preferred embodiment of the present invention, with a portion of the storm window broken away for purposes of illustration.

Referring now to the drawings in more detail, numeral 10 designates a conventional wooden window frame having vertical opposite sides 10*a* and 10*b*, and a top frame portion 10*c* and a bottom frame portion 10*d*. Upper and lower sashes 12 and 14 are received within the window frame and hold respective glass panes 16 and 18.

Figure 2:
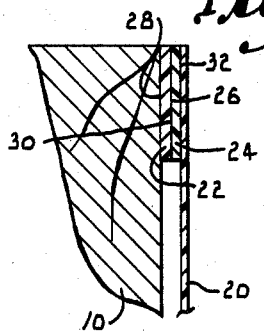
FIG. 2 is a fragmentary sectional view on an enlarged scale taken generally along line 2—2 of FIG. 1 in the direction of the arrows.

In accordance with the present invention, an inside storm window 20 is magnetically mounted to the window frame 10 by two magnetic tape strips 22 and 24. The tape strips 22 and 24 are identical to one another, and examples of suitable types of tape are tapes that are commercially available from the B. F. Goodrich Company and from the 3M Company. The magnetic tape is flexible and is normally provided in a roll. As best shown in FIG. 2, strip 22 has a flat magnetic side 26 and an opposite adhesive side 28 carrying a layer of pressure sensitive adhesive. Similarly, strip 24 has a magnetic side 30 and an opposite side 32 which carries a layer of pressure sensitive adhesive. The adhesive sides 28 and 32 of the tape are normally covered by a release liner (not shown) which may be peeled off of the tape to expose the adhesive.

Figure 3:
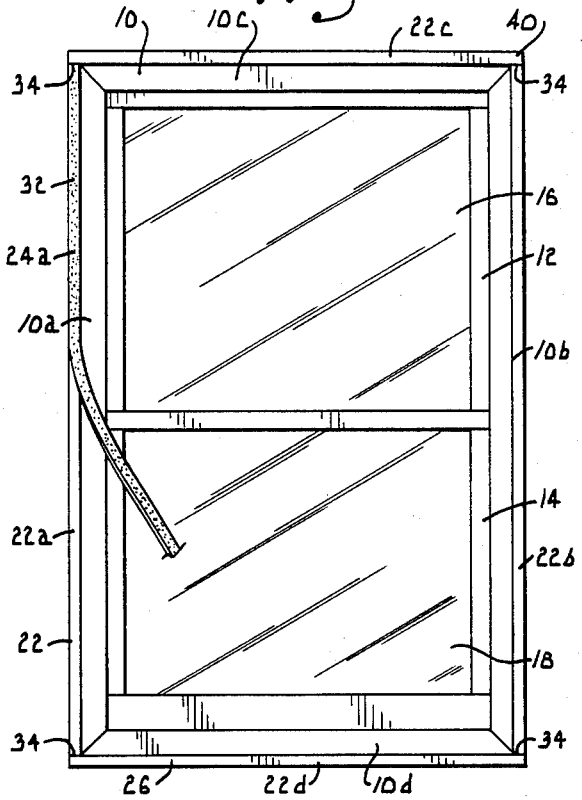
FIG. 3 is an elevational view showing one magnetic tape strip attached to the window frame and a second magnetic tape strip being applied to the first strip.

Strip 22 is applied to the window frame 10 by removing the release liner from the adhesive side of vertical portions 22*a* and 22*b* of the strip and applying the adhesive sides of these portions to the respective frame sides 10*a* and 10*b* along the outer edges thereof, as best shown in FIG. 3. A horizontal top tape portion 22*c* is similarly applied to the top portion 10*c* of the window frame by removing the release liner and applying the adhesive side of the strip to the window frame along its top edge. The release liner is likewise removed from a bottom horizontal portion 22*d* of the tape strip, and the adhesive side of portion 22*d* is then applied to the bottom frame portion 10*d* along its lower edge. Strip 22 is thus adhesively secured to frame 10 in a rectangular shape, and butt joints 34 are formed between the horizontal and vertical portions at each corner of the rectangle defined by the strip. In this manner, strip 22 extends in a continuous manner around the window with the magnetic side 26 of the tape strip facing inwardly into the room and away from frame 10.

The other tape strip 24 is then applied to strip 22 with the magnetic side 30 of the second strip in face to face contact with the magnetic side 26 of the first strip. To accomplish this, vertical portions 24*a* and 24*b* of strip 24 are applied to the respective vertical portions 22*a* and 22*b* of strip 22 and are adjusted in their positions until the magnetic sides of the tape strips magnetically adhere to one another along their entire lengths. Top and bottom portions 24*c* and 24*d* of strip 24 are similarly applied to portions 22*c* and 22*d* such that the adjacent magnetic faces of the strips magnetically attract one another along their entire lengths. Butt joints 36 (FIG. 4) are formed between the vertical and horizontal portions of strip 24 at the four corners of the rectangle defined when strip 24 is in place against strip 22.

Figure 4:
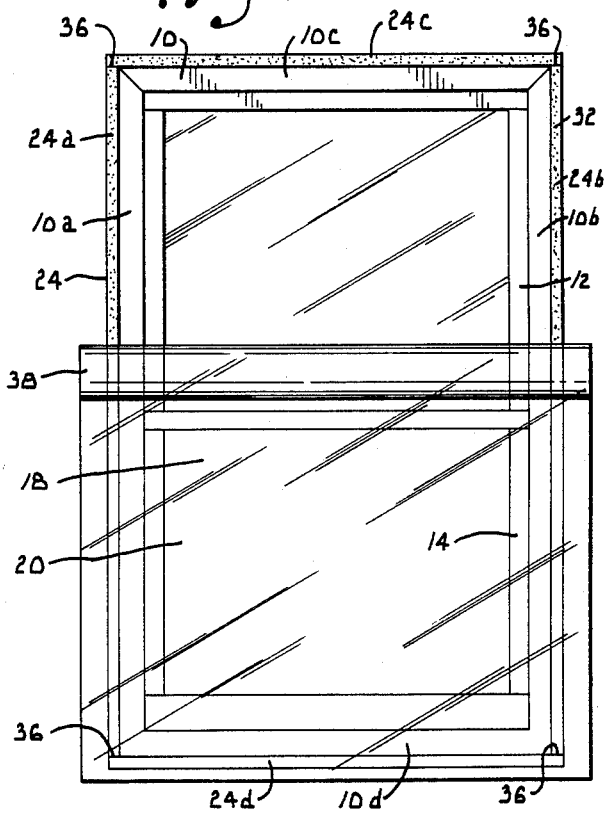
FIG. 4 is an elevational view illustrating the manner of application of the storm window to the adhesive side of the second magnetic tape strip.

When strip 24 has been applied to strip 22 in the manner indicated, the release liner is removed from strip 24 to expose its adhesive side 32 which faces inwardly into the room. The storm window 20 may be any suitable type of material and may be either flexible or rigid. In one form of the invention, the storm window is formed from polyester film approximately five mils thick and furnished in a roll 38. The width of the roll is preferably somewhat greater than the distance between portions 24*a* and 24*b* of tape strip 24. With the adhesive side of strip 24 exposed, the roll 38 is unrolled against the strip such that it is applied to the adhesive side 32 of the strip, as shown in FIG. 4. Preferably, the lower edge portion of the storm window 20 extends below portion 24*d* and, when fully applied, the top portion of the storm window extends above the upper portion 24*c*. When fully applied to strip 24, the storm window forms a flat pane which extends somewhat above and below and to both sides of strip 24. The excess material can be trimmed along the outer edges of strip portions 24*a*, 24*b*, 24*c* and 24*d* after the storm window has been applied to strip 24 in the manner indicated.

Preferably, strip 22 is provided with a mark as at 40 (FIG. 3) on its upper right-hand corner or in any other suitable position. The inwardly facing surface of storm window 20 is provided with a similar mark as at 42 (FIG. 1) in its upper right-hand corner adjacent tape strip 24. As will be more fully explained, the marks at 40 and 42 can be aligned with one another to assure proper orientation of the storm window.

Since the second tape strip 24 is positioned such that it magnetically adheres to the first tape strip 22 completely around the window, a tight seal is provided between the storm window and the window frame. Consequently, there are no air gaps presented through which cold air could leak to detract from the effectiveness of the storm window in sealing against leakage through the window. The magnetic tape strips are preferably of the type that have alternating north and south poles extending side by side along the length of the tape, with the polarity alternating across the width of the tape, since this type of magnetic tape has more attractive power than other types such as tapes having one face which is a south pole and another face which is a north pole. Consequently, if two strips of magnetic tape are applied to one another randomly, a south pole portion of one tape may be applied to a south pole portion of the other tape such that the tape strips would repel one another. Should this occur at any point along the strips, a gap results to permit leakage of air past the storm window.

It is pointed out that no areas of repulsion can be presented in the subject invention since tape strip 24 is initially applied to strip 22 and adjusted in position until the polarities of the two strips are oriented such that the north pole areas of one strip are disposed against the south pole areas of the other strip and vice versa, Only then is the storm window pane 20 applied to strip 24, and there are no air gaps presented at any point on the storm window. The magnetic faces 26 and 30 are magnetically attracted around the entirety of the window to establish an effective seal which prevents leakage of air in any appreciable quantity.

The storm window 20 can be removed and stored when not needed. Replacement of the storm window is carried out simply by applying it to the frame such that the proper portions of the tape strips are in contact with one another. Again, an effective seal is formed between the two tape strips since it is assured that they magnetically attract one another completely around the window. In order to prevent the possibility of the storm window being applied improperly (such as in an inverted position), the mark at 42 is aligned with the mark at 40 before the storm window is mounted to the frame.

The storm window pane is preferably a thin polyester film such as the material commercially available from the DuPont Company under the "Mylar" trademark. However, it is to be understood that other types of materials are equally well suited to the invention, and that more rigid window panes may be used if necessary or desirable. It should also be understood that various types of magnetic tape may be used to mount the storm window to the window frame. Either or both tape strips 22 and 24 can be painted, laminated, antiqued or otherwise treated to match with the frame and thus provide an attractive window structure.

If a rigid window pane constructed of glass or plexiglas material is used instead of the more flexible "Mylar" material, it may be desirable to permanently attach one tape strip to the pane prior to attaching the other strip permanently to the window frame. In this procedure, one strip is adhesively attached to the border of the pane, the other strip is applied face to face with the first strip and adjusted until the strips are aligned in magnetic polarity, and only then is the second strip adhesively attached to the frame. This method of installation assures that the tapes will be properly arranged in polarity to result in effective sealing of the pane to the window frame.

If the window frame has a sill at the bottom, an additional molding (not shown) can be provided for attachment between the vertical portions of the frame at a location immediately above the sill. This additional molding provides a surface to which the lower horizontal tape portion is adhesively applied.

Although the invention has been described in connection with an inside storm window and a wooden window frame, it should be understood that it is equally useful to hold outside storm windows, insect screens and other similar articles in place covering various types of openings such as those present in doors, automobile vehicles, boats and other structures.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scopr thereof, it is to be understood that all matter herein set forth or shown in the accompanying drawings is to be interpreted as illustrative and not in a limiting sense.

Having thus described the invention, we claim:

1. A method of releasably attaching an aperture covering panel to a frame surrounding the aperture; said method comprising the steps of:

(a) selecting a continuous and generally planar surface on said frame enclosing said aperture;

(b) providing first and second strips, each strip having an adhesive side and an opposite magnetic side, said magnetic side having spatially alternating north and south magnetic poles thereon;

(b) applying the adhesive side of said first strip to a first of said surface or said panel in a pattern to generally continuously surround said aperture;

(c) positioning the magnetic side of said second strip on the magnetic side of said first strip such that said second strip is generally coextensive with said first strip;

(d) adjusting said second strip in relation to said first strip to position the magnetic poles of said second strip in registration with opposite magnetic poles of said first strip to maximize the magnetic attraction between said first and second strips; and (e) thereafter placing a second of said surface or said panel in contact with the adhesive side of said second strip such that said panel is removably held so as to cover said aperture by the magnetic attraction between the magnetic sides of said first and second magnetic strips.

2. The method set forth in claim 1 wherein:

(a) said surface is an indoor surface of a window frame surrounding a window;

(b) said panel is a weather sealing cover member for said window; and (c) said first and second strips include respectively abutting segments which extend in surrounding and sealing relation about said surface of said window frame.

3. The method set forth in claim 1 including the steps of:

(a) providing aligned indicia on said first and second strips such that upon removal of said panel from said surface and subsequent replacement thereon, said strips may be accurately positioned for alignment of said magnetic poles of one of said strips with the opposite magnetic poles of the other of said strips.

4. A method of releasably installing a weather sealing member on a window comprising the steps of:

(a) providing first and second strips, each strip having an adhesive side and an opposite magnetic side, said magnetic side having spatially alternating north and south magnetic poles thereon;

(b) applying the adhesive side of said first strip in abutting segments to an indoor surface of a generally rectangular frame surrounding said window so as to generally surround said window;

(c) positioning the magnetic side of said second strip on the magnetic side of said first strip such that said second strip generally extends along said first strip and surrounds said window;

(d) adjusting said segments of said second strip in relation to said first strip to position the magnetic poles of said second strip in registration with the opposite magnetic poles of said first strip to maximize the magnetic attraction of said second strip to said first strip;

(e) thereafter stretching a weather sealing cover member over said window and securing said weather sealing cover member to the adhesive side of said second strip in covering relationship relative to said window such that said panel is securely but releasably held over said window by the attraction between the magnetic sides of said first and second magnetic strips; and (f) providing aligned indicia on said first and second strips such that upon removal of said cover member from said surface and subsequent replacement thereon, said second strip may be accurately positioned for alignment of the magnetic poles thereof with the opposite magnetic poles of said first strip.

* * * * *

UNITED STATES PATENT AND TRADEMARK OFFICE

CERTIFICATE OF CORRECTION

PATENT NO. : 4,510,986

DATED : April 16, 1985

INVENTOR(S) : Rose M. Schwankl et al

It is certified that error appears in the above-identified patent and that said Letters Patent is hereby corrected as shown below:

Insert Claim 5

5. The method set forth in Claim 4 wherein:

(a) said cover member is a flexible sheet the dimensions of which exceed the dimensions of said surface surrounding said window; and (b) trimming the excess portions of said sheet which extend past said strips subsequent to the securing of said sheet to said second strip.

On the title page "4 Drawing Figures" should read -- 5 Drawing Figures --.

Signed and Sealed this

*Twenty-fourth* Day of *September 1985*

[SEAL]

*Attest:*

*Attesting Officer*

DONALD J. QUIGG

*Commissioner of Patents and Trademarks—Designate*